US009181939B2

(12) United States Patent
Pham

(10) Patent No.: US 9,181,939 B2
(45) Date of Patent: Nov. 10, 2015

(54) COMPRESSOR CRANKCASE HEATING CONTROL SYSTEMS AND METHODS

(71) Applicant: Emerson Climate Technologies, Inc., Sidney, OH (US)

(72) Inventor: Hung Pham, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 246 days.

(21) Appl. No.: 14/079,271

(22) Filed: Nov. 13, 2013

(65) Prior Publication Data

US 2014/0138451 A1 May 22, 2014

Related U.S. Application Data

(60) Provisional application No. 61/727,425, filed on Nov. 16, 2012.

(51) Int. Cl.

| | |
|---|---|
| ***F04B 39/06*** | (2006.01) |
| ***F04B 35/04*** | (2006.01) |
| ***F04B 39/12*** | (2006.01) |
| ***F04B 49/06*** | (2006.01) |

(52) U.S. Cl.

CPC ..... *F04B 39/06* (2013.01); *F04B 35/04* (2013.01); *F04B 39/121* (2013.01); *F04B 49/06* (2013.01)

(58) Field of Classification Search

CPC ..... F04B 39/06; F04B 39/121; F04B 35/04; F04B 49/06; F25B 31/002; F25B 2500/16; F25B 2500/26; F25B 2700/1932; F25B 2700/2105

USPC ..... 237/12, 2 B, 13, 81

See application file for complete search history.

(56) References Cited

U.S. PATENT DOCUMENTS

| | | | | |
|---|---|---|---|---|
| 3,577,741 | A | 5/1971 | Shaw | |
| 3,705,499 | A | 12/1972 | Mount et al. | |
| 4,045,973 | A * | 9/1977 | Anderson | F24D 11/0009 318/778 |
| 4,066,869 | A | 1/1978 | Apaloo et al. | |
| 4,197,719 | A * | 4/1980 | Shaw | F04C 18/16 62/324.1 |

(Continued)

FOREIGN PATENT DOCUMENTS

| | | | |
|---|---|---|---|
| CN | 1391060 | A | 1/2003 |
| CN | 101319818 | A | 12/2008 |

(Continued)

OTHER PUBLICATIONS

International Search Report regarding Application No. PCT/US2010/050109, mailed May 3, 2011.

(Continued)

*Primary Examiner* — Gregory Huson
*Assistant Examiner* — Daniel E Namay
(74) *Attorney, Agent, or Firm* — Harness, Dickey & Pierce, P.L.C.

(57) ABSTRACT

A crankcase heating control system for a heat pump system includes a data receiving module and a power control module. The data receiving module receives data indicative of a temperature of a compressor of the heat pump system, data indicative of an ambient temperature, and data indicative of a current date and a current time. The power control module selectively applies power to a heater of a crankcase of the compressor and selectively disables the heater based on the temperature of the compressor, the ambient temperature, the current date, and the current time.

4 Claims, 13 Drawing Sheets

(56) References Cited

U.S. PATENT DOCUMENTS

| | | | | |
|---|---|---|---|---|
| 4,208,883 | A | 6/1980 | Stirling | |
| 4,274,581 | A * | 6/1981 | Hays | F24D 3/18 165/300 |
| 4,474,227 | A * | 10/1984 | Reedy | F24D 19/1087 165/11.1 |
| 4,483,388 | A * | 11/1984 | Briccetti | F24F 1/0003 165/232 |
| 4,605,831 | A | 8/1986 | Mitchell | |
| 4,940,079 | A * | 7/1990 | Best | F24D 19/1072 165/236 |
| 5,012,652 | A | 5/1991 | Dudley | |
| 5,052,897 | A | 10/1991 | Yamashita et al. | |
| 5,054,542 | A * | 10/1991 | Young | F24F 5/00 165/58 |
| 5,230,222 | A | 7/1993 | Erbs | |
| 5,369,958 | A | 12/1994 | Kasai et al. | |
| 6,523,361 | B2 | 2/2003 | Higashiyama | |
| 6,591,621 | B2 | 7/2003 | Loprete et al. | |
| 6,834,513 | B2 | 12/2004 | O'Brien et al. | |
| 6,848,268 | B1 | 2/2005 | Memory et al. | |
| 6,886,354 | B2 | 5/2005 | Dudley | |
| 6,904,759 | B2 | 6/2005 | Shoulders | |
| 7,096,681 | B2 | 8/2006 | Wills et al. | |
| 7,290,990 | B2 | 11/2007 | Lifson | |
| 7,331,187 | B2 | 2/2008 | Kates | |
| 7,712,329 | B2 * | 5/2010 | Shaw | F04B 39/0207 62/468 |
| 7,797,084 | B2 | 9/2010 | Miwa | |
| 8,160,827 | B2 * | 4/2012 | Jayanth | F04B 35/04 702/63 |
| 2002/0018724 | A1 | 2/2002 | Millet et al. | |
| 2002/0020175 | A1 | 2/2002 | Street et al. | |
| 2002/0129612 | A1 | 9/2002 | Saikusa et al. | |
| 2004/0068387 | A1 | 4/2004 | Bonanni et al. | |
| 2004/0083731 | A1 | 5/2004 | Lasker | |
| 2004/0211193 | A1 | 10/2004 | Van der Walt et al. | |
| 2005/0126171 | A1 | 6/2005 | Lasker | |
| 2005/0188708 | A1 | 9/2005 | Wills et al. | |
| 2006/0070398 | A1 | 4/2006 | De Bernardi et al. | |
| 2007/0006608 | A1 | 1/2007 | Lee | |
| 2008/0245083 | A1 | 10/2008 | Tutunoglu et al. | |
| 2009/0324427 | A1 | 12/2009 | Tolbert, Jr. et al. | |
| 2010/0011788 | A1 * | 1/2010 | Lifson | F25B 31/002 62/115 |
| 2010/0254834 | A1 | 10/2010 | Tolbert, Jr. | |
| 2010/0278660 | A1 | 11/2010 | Burchill et al. | |
| 2011/0070100 | A1 | 3/2011 | McSweeney et al. | |
| 2011/0083450 | A1 | 4/2011 | Turner et al. | |
| 2012/0227430 | A1 | 9/2012 | Takeuchi et al. | |

FOREIGN PATENT DOCUMENTS

| | | | |
|---|---|---|---|
| CN | 101392745 | A | 3/2009 |
| EP | 0546982 | A1 | 6/1993 |
| JP | 61016278 | | 1/1986 |
| JP | 10009685 | | 1/1998 |
| WO | WO-2009095989 | A1 | 8/2009 |
| WO | WO-2009096620 | A1 | 8/2009 |
| WO | WO-2009096923 | A1 | 8/2009 |
| WO | WO-2012125891 | A2 | 9/2012 |

OTHER PUBLICATIONS

Non-Final Office Action regarding U.S. Appl. No. 12/888,823, dated Jun. 11, 2013.

Written Opinion of the International Searching Authority regarding Application No. PCT/US2010/050109, mailed May 3, 2011.

Extended European Search Report regarding Application No. 12187632.0-1602 / 2589898, dated Dec. 13, 2013.

International Search Report regarding Application No. PCT/US2013/070082, dated Feb. 20, 2014.

Written Opinion of the International Searching Authority for PCT/US2013/070082, mailed Feb. 20,2014.

First Office Action and Search Report from State Intellectual Property Office of People's Republic of China regarding Chinese Patent Application No. 201080042651.7, dated Jan. 15, 2014. Translation provided by Unitalen at Law.

First Chinese Office Action regarding Application No. 201210436480.7, dated Dec. 26, 2014. Translation obtained from espacenet.com.

Non-Final Office Action regarding U.S. Appl. No. 13/664,805, dated May 8, 2015.

International Search Report regarding Application No. PCT/US2014/056120, mailed Dec. 17, 2014.

Written Opinion of the International Searching Authority regarding Application No. PCT/US2014/056120, mailed Dec. 17, 2014.

* cited by examiner

COMPRESSOR CRANKCASE HEATING CONTROL SYSTEMS AND METHODS

CROSS-REFERENCE TO RELATED APPLICATIONS

This application claims the benefit of U.S. Provisional Application No. 61/727,425, filed on Nov. 16, 2012. The entire disclosure of the application referenced above is incorporated herein by reference.

FIELD

The present disclosure relates to compressors and more particularly to heater control systems and methods for use with compressors.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Compressors may be used in a wide variety of industrial and residential applications to circulate refrigerant within a refrigeration, heat pump, HVAC, or chiller system (generically "heat pump systems") to provide a desired heating or cooling effect. In any of the foregoing applications, the compressor should provide consistent and efficient operation to ensure that the particular heat pump system functions properly.

Compressors may include crankcases to house moving parts of the compressor, such as a crankshaft. Crankcases may further include lubricant sumps, such as an oil reservoir. Lubricant sumps include lubricants that lubricate the moving parts of compressors. Lubrication of the moving parts may improve performance and/or prevent damage.

Lubricants in the crankcases may cool to low temperatures when the compressor is not running. For example, the crankcases may cool due to a low outdoor ambient temperature. Additionally, lubricants may cool and/or be diluted when liquid refrigerant returns to the compressor during the running cycle. Lubricant cooling may also occur under other circumstances.

Lubricant properties may change at low temperatures. More specifically, lubricants may become more viscous (i.e., thicker) at low temperatures. Starting a compressor with a low crankcase temperature and/or a significant amount of liquid within the shell may cause bearing wear and/or decreased performance due to insufficient lubrication.

SUMMARY

In a feature, a crankcase heating control system for a heat pump system includes a data receiving module and a power control module. The data receiving module receives data indicative of a temperature of a compressor of the heat pump system, data indicative of an ambient temperature, and data indicative of a current date and a current time. The power control module selectively applies power to a heater of a crankcase of the compressor and selectively disables the heater based on the temperature of the compressor, the ambient temperature, the current date, and the current time.

In a feature, a heat pump system includes: a compressor; first and second heat exchangers; an expansion valve; and a control module. The control module includes a processor and memory. The memory includes instructions that, when executed by the processor, perform the functions of: while the compressor is off, selectively applying power to a heater of a crankcase of the compressor; and while the compressor is off, selectively disabling the heater based on a temperature of the compressor, an ambient temperature, a current date, and a current time.

In a feature, a crankcase heating control method for a heat pump system includes: receiving data indicative of a temperature of a compressor of the heat pump system; receiving data indicative of an ambient temperature; and receiving data indicative of a current date and a current time. The crankcase heating control method further includes: selectively applying power to a heater of a crankcase of the compressor; and selectively disabling the heater based on the temperature of the compressor, the ambient temperature, the current date, and the current time.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1A:
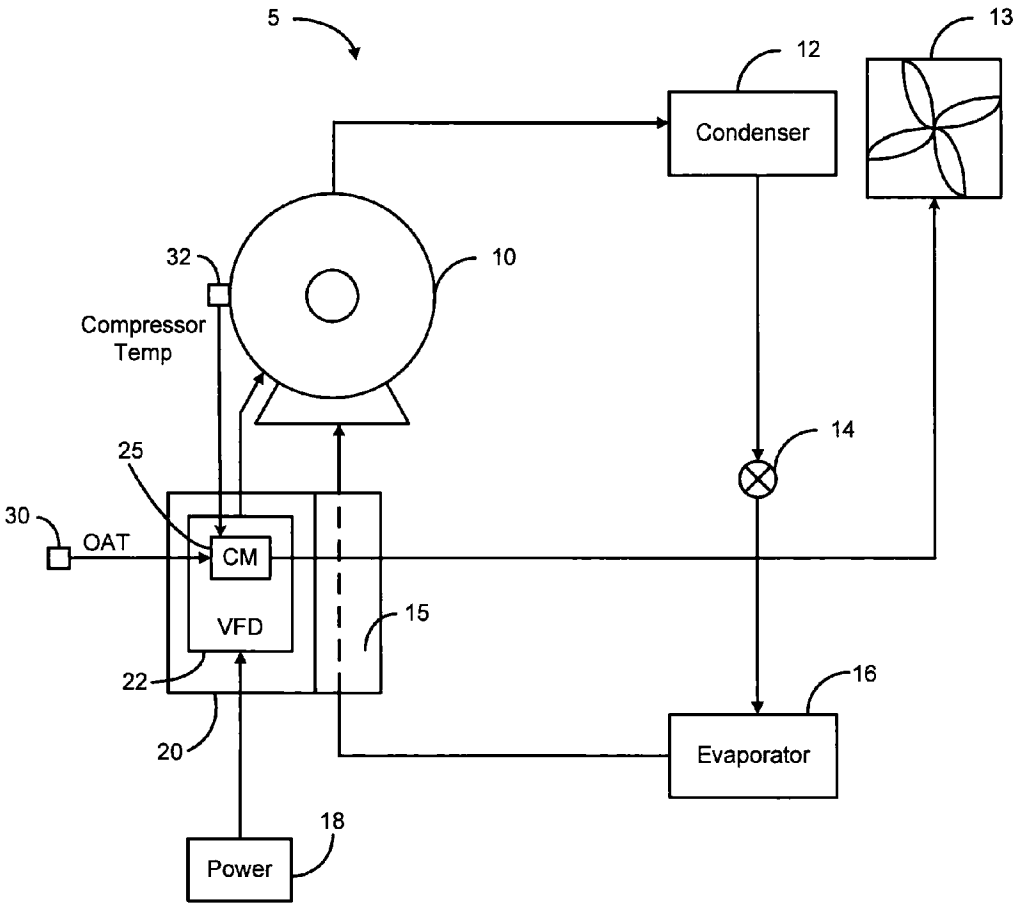
FIG. 1A is a functional block diagram of a first example heat pump system according to the present disclosure.

Compressors may include heating elements that heat crankcases in order to avoid problems related to "cold starting" or "liquid flood-back." "Cold starting" may refer to startup of a compressor when lubricants within the compressor are cold and diluted by refrigerant. The lubricants therefore are less viscous and have lower lubricating capabilities during cold starting, which may cause higher stress on one or more compressor components, such as a bearing.

Heating the crankcase of a compressor increases a temperature of lubricants inside the crankcase. Increasing the temperature of the lubricants may improve performance and/or prevent damage to the compressor due to the increased viscosity of cold lubricants. "Liquid flood-back" may refer to when liquid migrates into the compressor shell. Liquid migrates back to a compressor when the compressor is off and the compressor temperature is less than (its surrounding) ambient temperature. Heating the crankcase of the compressor may minimize liquid migration to the compressor and may remove liquid that has migrated to the compressor.

Typical crankcase heating elements, hereinafter referred to as "crankcase heaters," may operate in different ways. For example, a crankcase heater may run continuously while the compressor is in an off state (i.e., not compressing). Continuous use of a crankcase heater while the compressor is in the off state may heat the lubricant more than is required to avoid "cold starting." However, this continuous use of a crankcase heater is less efficient than desired due to wasted energy from excessive heating.

Additionally, typical crankcase heaters may operate at a constant power level, such as 40 watts. The period necessary for a 40 watt crankcase heater to warm the lubricant may be significant and may increase as temperature decreases. Moreover, one or more regulatory requirements may require average power consumption to decrease on a seasonal basis. For example, one or more regulatory requirements that currently provide for an average of 40 watts on a seasonal basis may be reduced by approximately 25 percent to approximately 40 percent or more (to an average of approximately 30 watts or approximately 25 watts).

Thus, systems and methods for more efficient crankcase heating are disclosed. Crankcase heating may be turned on or off based on an outdoor ambient temperature, a compressor temperature, both the outdoor ambient temperature and the compressor temperature, and/or a current date and time. For example, crankcase heating may be turned off for a predetermined period (e.g., approximately 3 hours) after the compressor is transitioned to the off state. The predetermined period may be set shorter than a period necessary for a predetermined amount of liquid migration back to the compressor shell to occur after the compressor is transitioned to the off state. Additionally or alternatively, crankcase heating may be turned off when the outdoor ambient temperature is greater than a predetermined temperature (e.g., approximately 75 degrees Fahrenheit). Additionally or alternatively, crankcase heating may be turned off when the compressor temperature minus the outdoor ambient temperature is greater than a first predetermined temperature (e.g., approximately 20 degrees Fahrenheit), and crankcase heating may be turned on when the compressor temperature minus the outdoor ambient temperature is less than a second predetermined temperature (e.g., 0 degrees Fahrenheit). The first predetermined temperature may be set based on a temperature indicative of little liquid remaining in the compressor shell. Additionally or alternatively, crankcase heating may be turned off when the compressor has been in the off state for a predetermined period (e.g., approximately 3 weeks) and the outdoor ambient temperature and the compressor temperature are less than a predetermined temperature (e.g., approximately 55 degrees Fahrenheit). The predetermined period and the predetermined temperature may be set such to be indicative of air conditioning being turned off for a season. Additionally or alternatively, crankcase heating may be turned off within a predetermined range of dates (e.g., approximately November 1 to approximately April 1 in the northern hemisphere). Additionally or alternatively, crankcase heating may be turned off for a predetermined period (e.g., approximately 12 am to approximately 10 am daily during diurnal cycle). Additionally or alternatively, crankcase heating may be turned off for the next predetermined duration (e.g., the next X number of days, weeks, or months). Disabling crankcase heating at times when crankcase heating would otherwise be performed decreases energy consumption and increases efficiency.

Various types of crankcase heaters can be used. For example, belly-band crankcase heaters encircle a shell of a compressor. Positive temperature coefficient (PTC) crankcase heaters are inserted within the shell of the compressor. The stator of an electric motor of the compressor can also be used as a crankcase heater.

For heating the crankcase via the stator, an electronic circuit delivers power to the stator of the electric motor of the compressor. The stator is a non-moving part of the electric motor in the compressor. When the compressor is on, the stator may magnetically drive a rotor that in turn drives a crankshaft. The crankshaft may, in turn, drive a compression mechanism of the compressor. However, when the compressor is in the off state, the stator may generate heat when supplied with current, and thus the stator may act as a heater for the lubricants inside the compressor and evaporate liquid refrigerant.

Figure 1B:
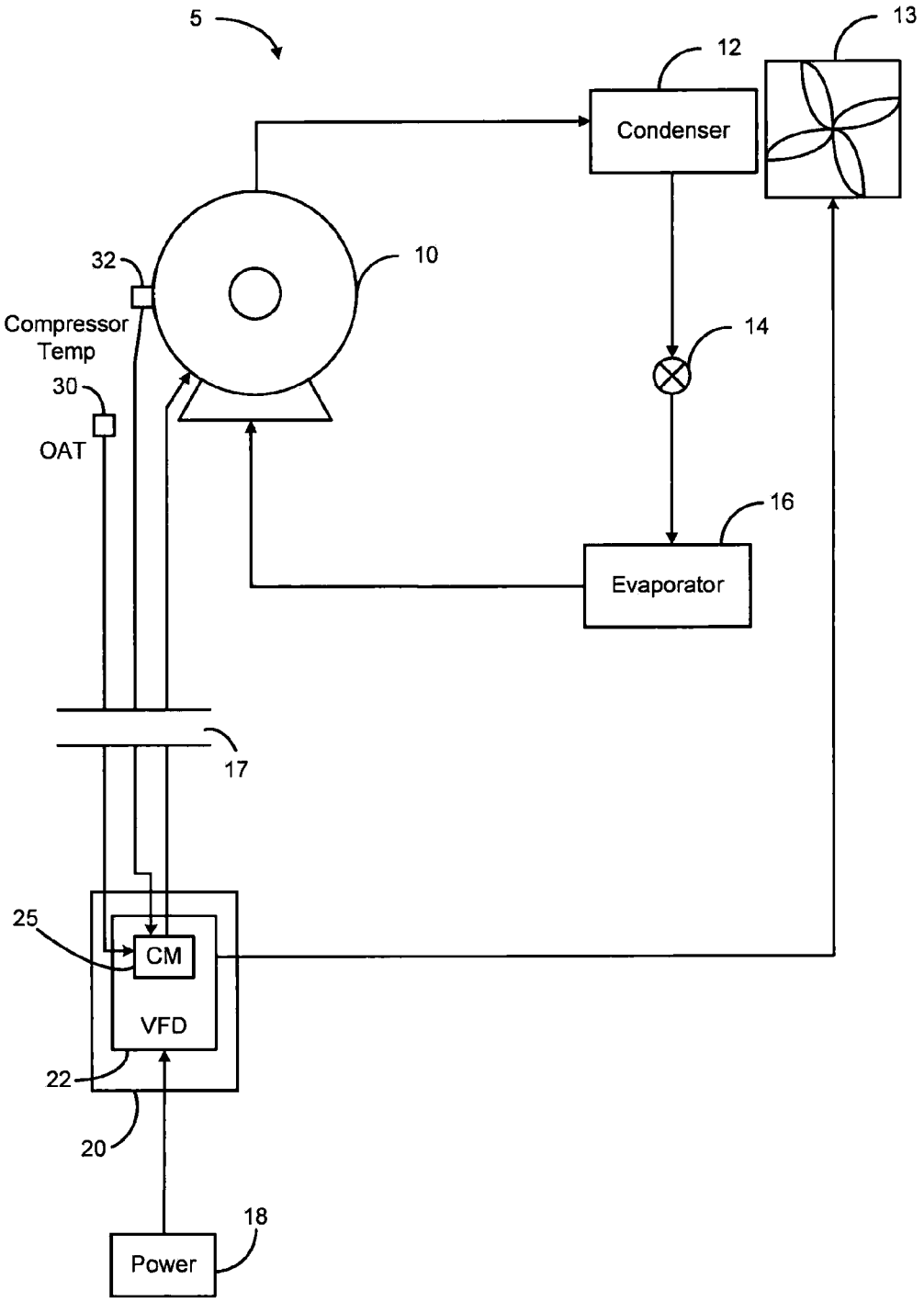
FIG. 1B is a functional block diagram of a second example heat pump system according to the present disclosure.

With reference to FIGS. 1A and 1B, functional block diagrams of example heat pump systems 5 are presented. The heat pump systems 5 include a compressor 10 that includes a shell that houses a compression mechanism. In an on state, the compression mechanism is driven by an electric motor to compress refrigerant vapor. In an off state, the compression mechanism does not compress refrigerant vapor.

Figure 4:
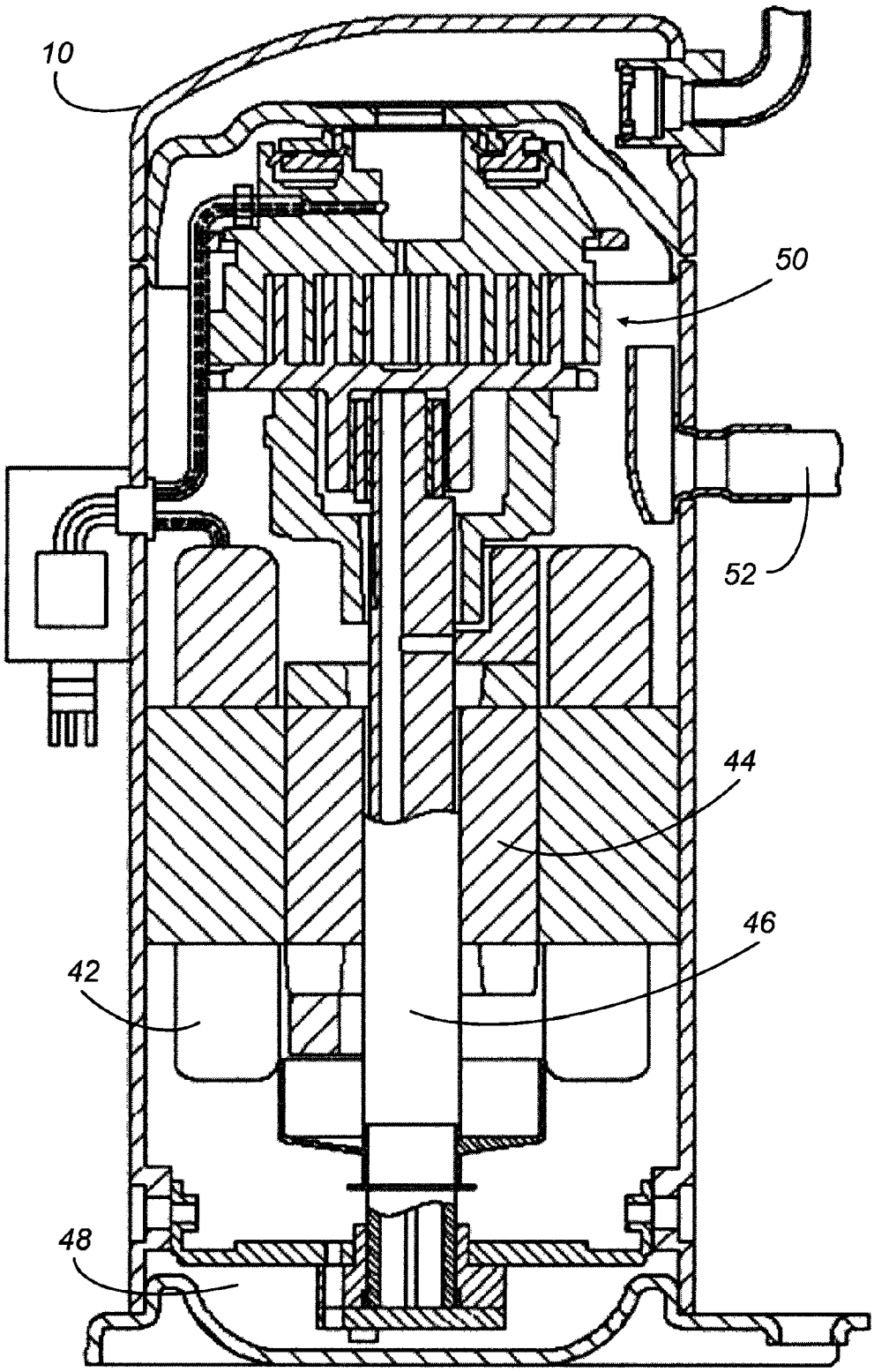
FIG. 4 is a cross-sectional view of an example compressor according to the present disclosure.

In the example heat pump systems 5, the compressor 10 is depicted as a scroll compressor and the compression mechanism includes a scroll having a pair of intermeshing scroll members, shown in FIG. 4. The present teachings, however, also apply to other types of compressors utilizing other types of compression mechanisms.

For example, the compressor 10 may be a reciprocating compressor and the compression mechanism may include at least one piston driven by a crank shaft for compressing refrigerant vapor. As another example, the compressor 10 may be a rotary compressor and the compression mechanism may include a vane mechanism for compressing refrigerant vapor. Further, while a specific type of heat pump system is shown in FIGS. 1A and 1B (a refrigeration system), the present teachings are also applicable to other types of heat pump systems, including other types of refrigeration systems, HVAC systems, chiller systems, and other suitable types of heat pump systems where crankcase heating is used.

Refrigerant vapor from the compressor 10 is delivered to a condenser 12 where the refrigerant vapor is liquefied at high pressure, thereby rejecting heat to the outside air. A condenser fan 13 may be implemented to regulate airflow past the condenser 12. The liquid refrigerant exiting the condenser 12 is delivered to an evaporator 16 through an expansion valve 14. The expansion valve 14 may be a mechanical, thermal, or electronic valve for controlling super heat of the refrigerant entering the compressor 10.

The refrigerant passes through the expansion valve 14 where a pressure drop causes the high pressure liquid refrigerant to achieve a lower pressure combination of liquid and vapor. As hot air moves across the evaporator 16, the low pressure liquid turns into gas, thereby removing heat from the hot air adjacent the evaporator 16. While not shown, a fan is generally provided to facilitate airflow past the evaporator 16.

The low pressure gas is delivered to the compressor 10 where it is compressed to a high pressure gas, and delivered to the condenser 12 to start the heat pump cycle again.

Figure 2:
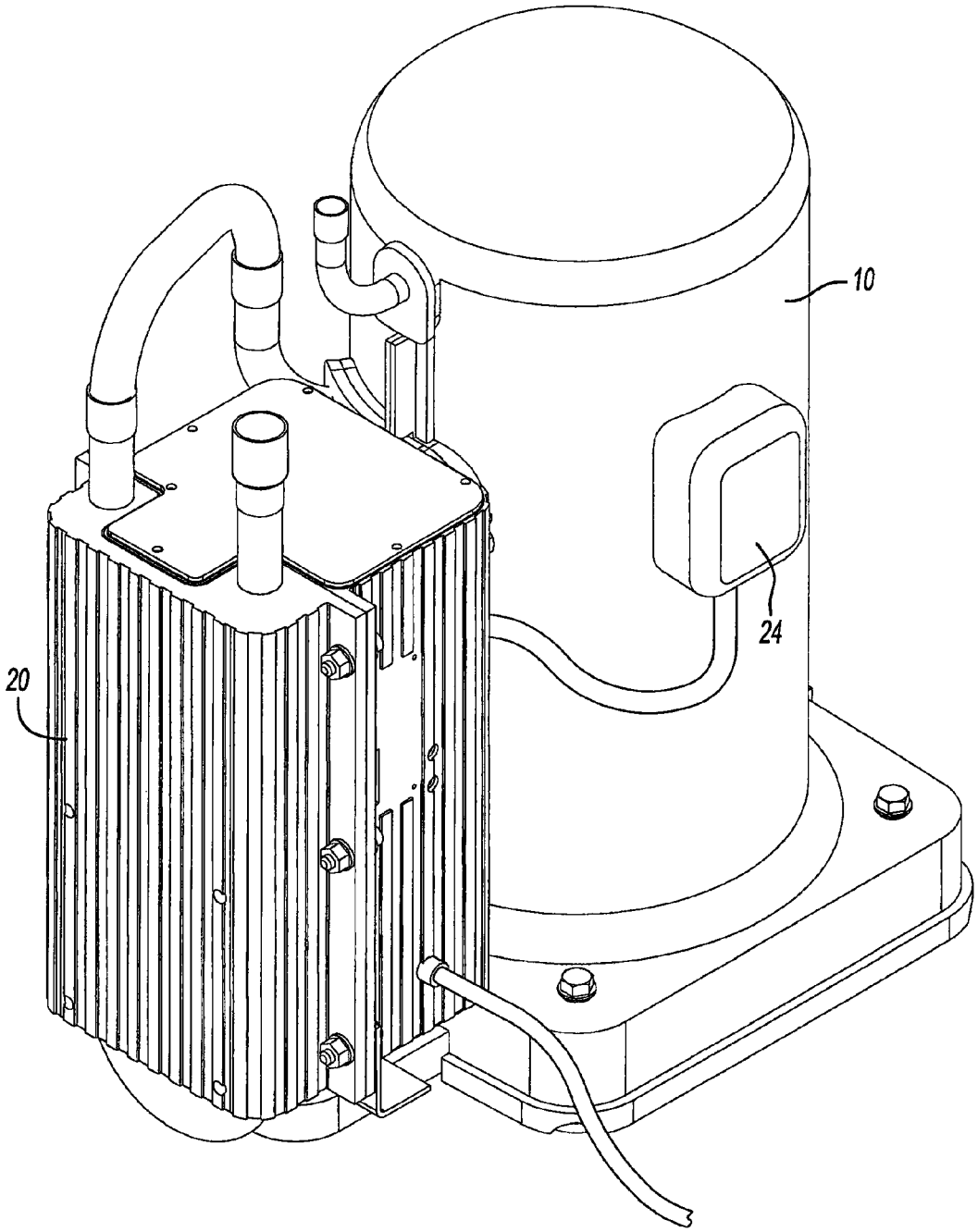
FIG. 2 is a perspective view of a compressor with a variable frequency drive according to the present disclosure.
Figure 3:
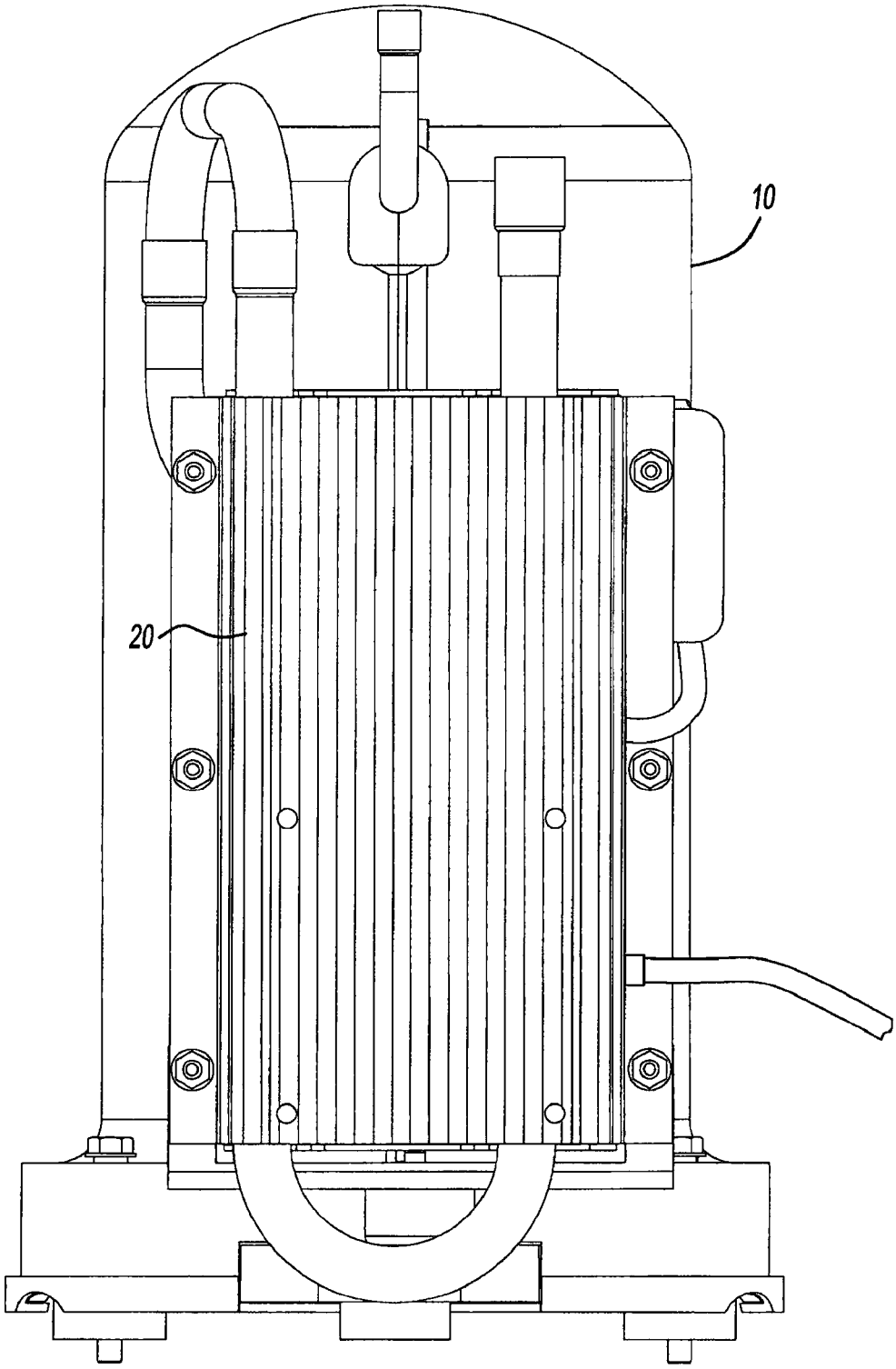
FIG. 3 is another perspective view of a compressor with a variable frequency drive according to the present disclosure.

With reference to FIGS. 1A, 1B, 2 and 3, the compressor 10 may be driven by a variable frequency drive (VFD) 22, also referred to as an inverter drive, that is housed in an enclosure 20. The enclosure 20 may be near or away from the compressor 10. Specifically, with reference to FIG. 1A, the VFD 22 is shown near the compressor 10. For example, as shown in FIGS. 2 and 3, the VFD 22 may be attached (as part of the enclosure 20) to the compressor 10. Alternatively, with reference to FIG. 1B, the VFD 22 may be located away from the compressor 10 by a separation 17. For example only, the separation 17 may a wall. In other words, the VFD 22 may be located inside a building and the compressor 10 may be located outside of the building or in a different room than the compressor 10.

The VFD 22 receives an alternating current (AC) voltage from a power supply 18 and delivers AC voltage to the compressor 10. The VFD 22 may include a control module 25 with a processor and software operable to modulate and control the frequency and/or amplitude of the AC voltage delivered to an electric motor of the compressor 10.

The control module 25 may include a computer readable medium for storing data including software and/or firmware executed by a processor to modulate and control the frequency and/or amplitude of voltage delivered to the compressor 10 and to execute and perform the crankcase heating and control functions disclosed herein. By modulating the frequency and/or amplitude of voltage delivered to the electric motor of the compressor 10, the control module 25 may thereby modulate and control the speed, and consequently the capacity, of the compressor 10. The control module 25 also regulates operation of the condenser fan 13.

The VFD 22 may include solid state electronic circuitry to modulate the frequency and/or amplitude of the AC voltage. Generally, the VFD 22 converts the input AC voltage from AC to DC, and converts from DC back to AC at a desired frequency and/or amplitude. For example, the VFD 22 may directly rectify the AC voltage with a full-wave rectifier bridge. The VFD 22 may switch the voltage using insulated gate bipolar transistors (IGBTs) or thyristors to achieve the desired output (e.g., frequency, amplitude, current, and/or voltage). Other suitable electronic components may be used to modulate the frequency and/or amplitude of the AC voltage from the power supply 18.

Piping from the evaporator 16 to the compressor 10 may be routed through the enclosure 20 to cool the electronic components of the VFD 22 within the enclosure 20. The enclosure 20 may include a cold plate 15. Suction gas refrigerant may cool the cold plate 15 prior to entering the compressor 10 and thereby cool the electrical components of the VFD 22. In this way, the cold plate 15 may function as a heat exchanger between suction gas and the VFD 22 such that heat from the VFD 22 is transferred to suction gas prior to the suction gas entering the compressor 10.

However, as shown in FIG. 1B, the enclosure 20 may not include the cold plate 15 and thus the VFD 22 may not be cooled by suction gas refrigerant. For example, the VFD 22 may be air cooled by a fan. As a further example, the VFD 22 may be air cooled by the condenser fan 13, provided the VFD 22 and the condenser 12 are located within sufficient proximity to each other. As shown in FIGS. 2 and 3, voltage from the VFD 22 may be delivered to the compressor 10 via a terminal box attached to the compressor 10.

FIG. 4 includes an example cross-sectional view of the compressor 10. While a variable speed scroll compressor is shown and discussed, the present application is also applicable to other types of compressors, such as reciprocating compressors, and rotary compressors.

The compressor 10 includes a stator 42 that magnetically turns a rotor 44 to drive a crankshaft 46 in an on state. Power flow to the stator 42 controls magnetization of the stator 42. Power can also be applied to the stator 42 to control magnetization such that the rotor 44 is not driven while power is applied to the stator 42.

A lubricant sump 48 includes lubricant (e.g. oil) that lubricates moving parts of the compressor 10 such as the crankshaft 46. The compressor 10 also includes a fixed scroll and an orbiting scroll, generally indicated by 50. When the scrolls 50 are meshed, rotation of the crankshaft 46 drives one of the scrolls 50 to compress refrigerant that is received through a suction tube 52. The scrolls 50 can be unmeshed under some circumstances such that the scrolls 50 do not compress refrigerant. For example, the scrolls 50 can be unmeshed during a predetermined startup period for crankcase heating, as discussed further below.

An ambient temperature sensor 30 measures outdoor ambient temperature (OAT) outside of the compressor 10 and/or the enclosure 20. In various implementations, the ambient temperature sensor 30 may be included as part of an existing system and thus be available via a shared communication bus.

A compressor temperature sensor 32 measures a temperature (Compressor temperature) of the compressor 10. For example only, the compressor temperature sensor 32 may measure temperature at the discharge line of the compressor 10, which may be referred to as discharge line temperature (DLT). Other examples of the temperature measured by the compressor temperature sensor 32 include, but are not limited to, temperature in the lubricant sump 48, temperature of the stator 42, a temperature at a top portion of the shell of the compressor 10, a temperature at a bottom portion of the shell, a temperature at a point between the top and bottom portions of the shell, and another suitable compressor temperatures. The temperature of the stator 42 may be measured or derived, for example, based on resistance of the motor windings.

The control module 25 also regulates a lubricant temperature in the lubricant sump 48 of the compressor 10. More specifically, the control module 25 regulates operation of a compressor crankcase heater (CCH). The CCH may include, for example, the stator 42, a positive temperature coefficient (PTC) heater within the compressor 10, a belly band type heater that encircles the shell of the compressor 10, or another suitable type of electric heater that heats the crankcase of the compressor 10.

Figure 5:
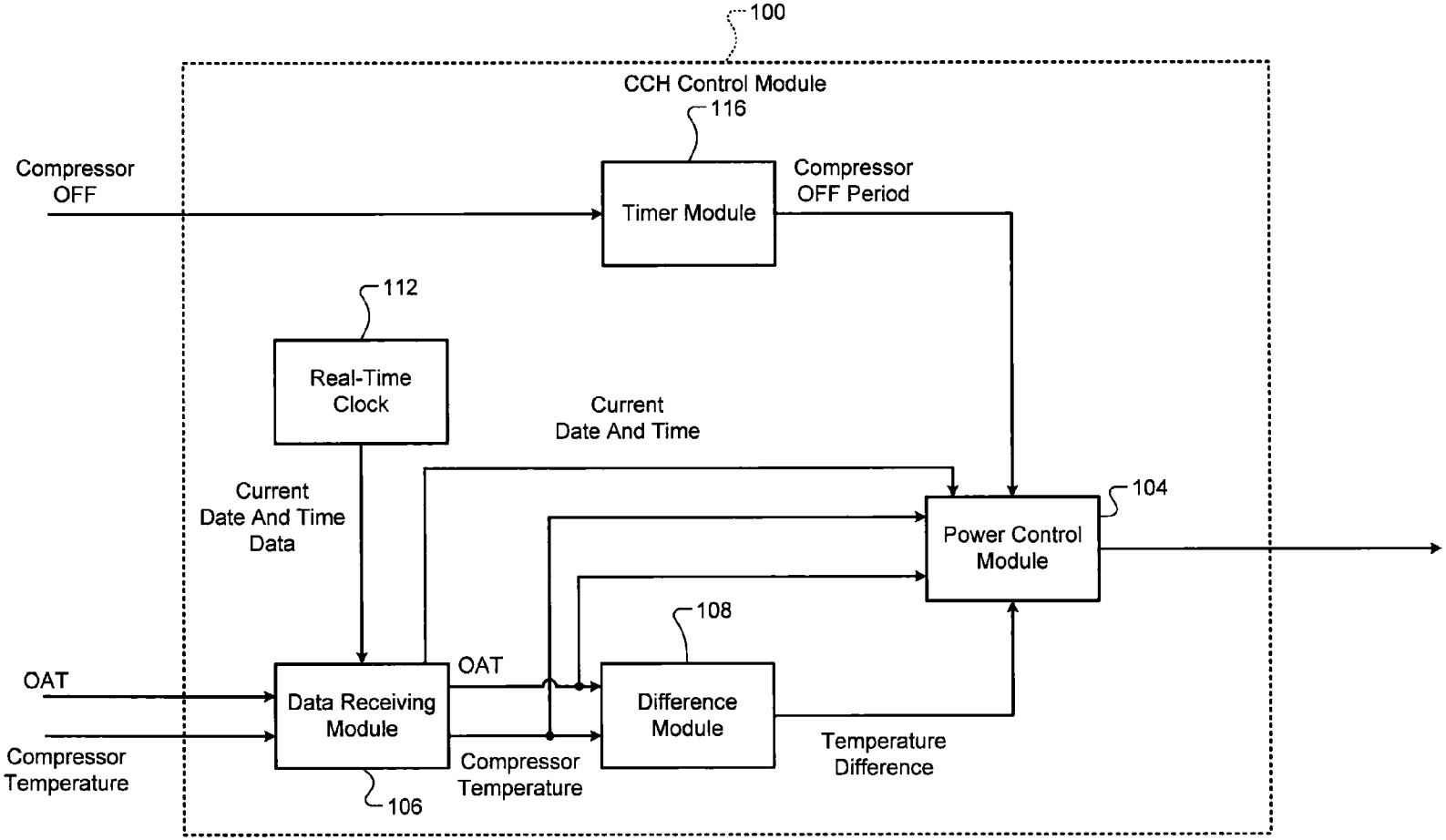
FIG. 5 is a functional block diagram of an example crankcase heating control module according to the present disclosure.

Referring now to FIG. 5, a functional block diagram of an example implementation of a compressor crankcase heater (CCH) control module 100 is presented. The CCH control module 100 may include, be a part of, or be independent of the control module 25. A power control module 104 controls whether the CCH is on or off. The power control module 104 may also control the output of the CCH, for example, in the case of a belly band type heater or a PTC heater. The power control module 104 generally maintains the CCH off while the compressor 10 is on.

The power control module 104 controls operation of the CCH based on the OAT, the compressor temperature, both the OAT and the compressor temperature, and/or current date and time data. A data receiving module 106 may receive the OAT, the compressor temperature, and the current date and time data and output the OAT, the compressor temperature, and the current date and time. The data receiving module 106 may filter, digitize, buffer, and/or perform one or more processing actions on the received data.

A difference module 108 may determine a temperature difference based on the OAT and the compressor temperature. More specifically, the difference module 108 may set the temperature difference equal to the compressor temperature minus the OAT. While setting the temperature difference equal to the compressor temperature minus the OAT is discussed, the temperature difference may alternatively be set equal to the OAT minus the compressor temperature or an absolute value of a difference between the compressor temperature and the OAT.

A real-time clock module 112 may track and provide the current date and time data. The current date and time data may indicate a current date (date, month, year) and current time. While the real-time clock module 112 is shown as being implemented within the CCH control module 100, the current date and time data may be provided in another manner. For example, the current date and time data may be provided by a thermostat or via a network connection (e.g., by a server, a mobile device, or another suitable type of external device including a processor).

Figure 6:
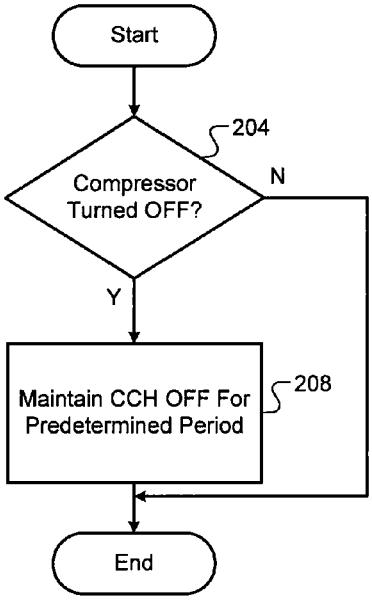
FIGS. 6-14 are flowcharts depicting example methods of controlling crankcase heating according to the present disclosure.

As stated above, the power control module 104 controls operation of the CCH based on the OAT, the compressor temperature, both the OAT and the compressor temperature, and/or current date and time data. FIG. 6 is a flowchart depicting an example method of controlling the CCH.

Referring now to FIG. 6, control may begin with 204 when the compressor 10 is on and the CCH is off. At 204, the power control module 104 determines whether the compressor 10 has transitioned to the off state. If false, control may remain at 204. If true, the power control module 104 may maintain the CCH off for a first predetermined period at 208. In this manner, the power control module 104 may maintain the CCH off for the first predetermined period after the compressor 10 is turned off. The first predetermined period may be set based on experimental data taken regarding the migration rate of liquid into the compressor shell after the compressor 10 is turned off relative to the volume of the compressor shell. For example only, the first predetermined period may be between approximately 30 minutes and approximately 3 hours or another suitable period.

Figure 7:
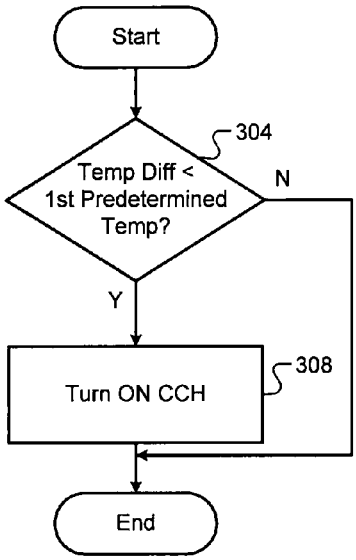

FIG. 7 is a flowchart depicting another example method of controlling the CCH. Referring now to FIG. 7, control may begin with 304 where the CCH is off and the compressor 10 is off. At 304, the power control module 104 determines whether the temperature difference is less than a first predetermined temperature. In other words, the power control module 104 determines whether the compressor temperature minus the OAT is less than the first predetermined temperature at 304. If false, the power control module 104 may leave the on/off state of the CCH unchanged. If true, the power control module 104 may turn the CCH on at 308. For example only, the first predetermined temperature may be approximately 0 (zero) degrees Fahrenheit or another suitable temperature below which "cold start" and/or "liquid flood-back" may occur.

The power control module 104 may maintain the CCH on, for example, for a second predetermined period and/or, as discussed further below, until the temperature difference becomes greater than a second predetermined temperature. The second predetermined period may be set, for example, based on a period of the CCH being on necessary to increase the temperature difference to greater than the second predetermined temperature. The second predetermined period may be fixed or variable. In the case of the second predetermined period being a variable, the power control module 104 may determine the second predetermined period, for example, as a function of the compressor temperature and/or the OAT. In the case of the second predetermined temperature being a fixed value, the second predetermined temperature may be, for example, approximately 10 degrees Fahrenheit or another suitable temperature.

Figure 8:
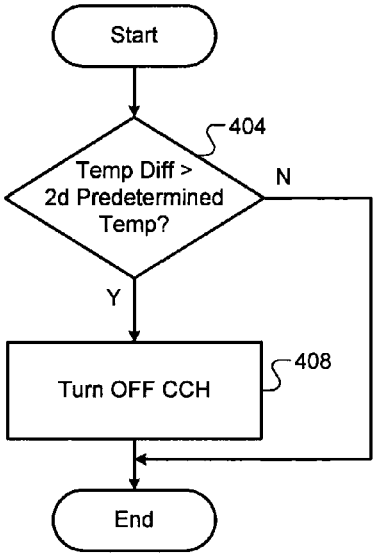

FIG. 8 is a flowchart depicting another example method of controlling the CCH. Referring now to FIG. 8, control may begin with 404 where the CCH is on and the compressor 10 is off. At 404, the power control module 104 determines whether the temperature difference is greater than the second predetermined temperature. In other words, the power control module 104 determines whether the compressor temperature minus the OAT is greater than the second predetermined temperature at 404. If false, the power control module 104 may leave the on/off state of the CCH unchanged. If true, the power control module 104 may turn the CCH off at 408. The second predetermined temperature may be set, for example, to approximately 15 degrees Fahrenheit, approximately 20 degrees Fahrenheit, or another suitable temperature that is greater than the first predetermined temperature.

Figure 9:
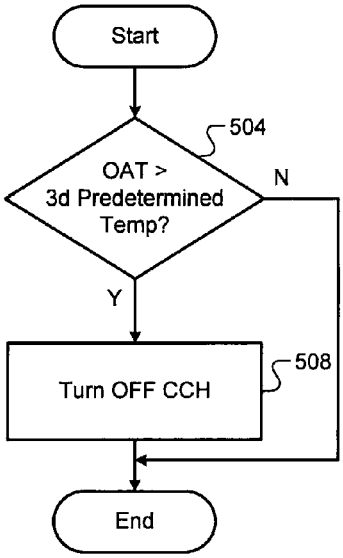

FIG. 9 is a flowchart depicting another example method of controlling the CCH. Referring now to FIG. 9, control may begin with 504 where the compressor 10 is off. At 504, the power control module 104 determines whether the OAT is greater than a third predetermined temperature. If false, the power control module 104 may leave the on/off state of the CCH unchanged. If true, the power control module 104 may turn the CCH on at 508. The third predetermined temperature may be set, for example, to approximately 75 degrees Fahrenheit or another suitable temperature.

Figure 10:
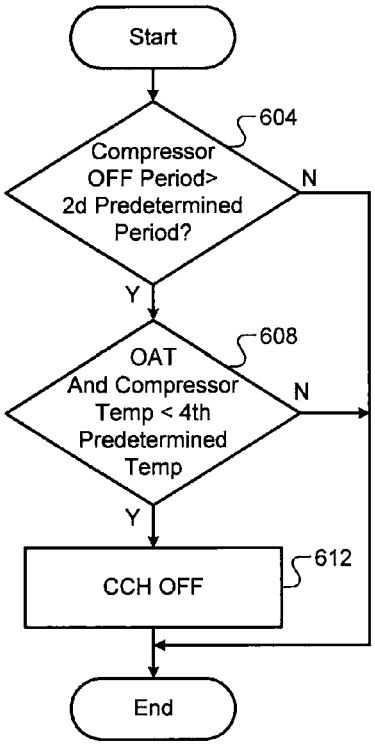

FIG. 10 is a flowchart depicting another example method of controlling the CCH. Referring now to FIG. 10, control may begin with 604 where the power control module 104 determines whether a period that the compressor 10 has been off is greater than a second predetermined period. The period that the compressor 10 has been off (continuously) since the compressor 10 was last turned off can be referred to as a compressor off period. A timer module 116 (FIG. 5) may reset and start the compressor off period in response to receipt of an indicator that the compressor 10 is in the off state.

If the compressor off period is greater than the second predetermined period, control may continue with 608. If the compressor off period is not greater than the second predetermined period, the power control module 104 may leave the on/off state of the CCH unchanged. The second predetermined period may be set, for example, to approximately 3 weeks or another suitable period.

At 608, the power control module 104 may determine whether the OAT and the compressor temperature are both less than a fourth predetermined temperature. If true, the power control module 104 may turn the CCH off at 612. If false, the power control module 104 may leave the on/off state of the CCH unchanged. The fourth predetermined temperature may be set, for example, to approximately 55 degrees Fahrenheit or another suitable temperature that is less than the third predetermined temperature.

The compressor off period being greater than the second predetermined period may indicate that the heat pump system (and more specifically air conditioning) has been shut down for the season (e.g., seasonally for winter). The compressor temperature and/or the OAT being less than the fourth predetermined temperature may be used to verify that the heat pump system has been shut down. In various implementations, 608 may be omitted, and the power control module 104 may turn the CCH off in response to a determination that the compressor off period is greater than the second predetermined period.

Figure 11:
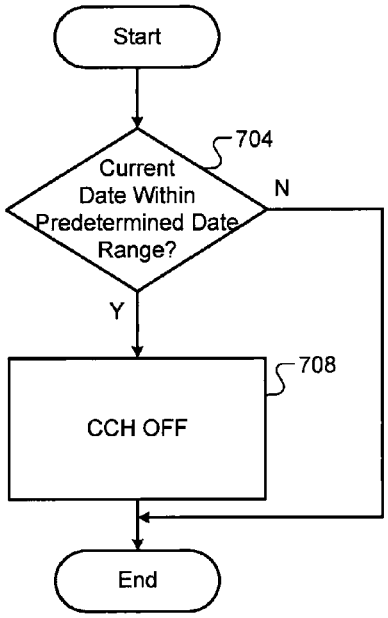

FIG. 11 is a flowchart depicting another example method of controlling the CCH. Referring now to FIG. 11, control may begin with 704 where the compressor 10 is off. At 704, the power control module 104 determines whether the current date indicated in the current date and time data is within a predetermined date range. If false, control may leave the on/off state of the CCH unchanged. If true, the power control module 104 may turn the CCH off at 708. The predetermined date range may be set, for example, to approximately November 1 through approximately April 1, yearly, or another suitable date range when the heat pump system (and more specifically air conditioning) is expected to remain off.

Figure 12:
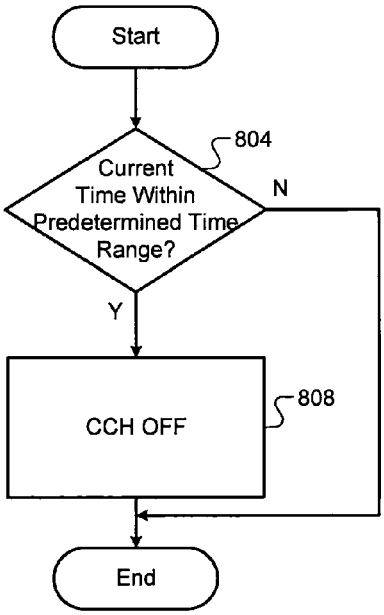

FIG. 12 is a flowchart depicting another example method of controlling the CCH. Referring now to FIG. 12, control may begin with 804 where the compressor 10 is off. At 804, the power control module 104 determines whether the current time indicated in the current date and time data is within a predetermined time range. If false, the power control module 104 may leave the on/off state of the CCH unchanged. If true, the power control module 104 may turn the CCH off at 808. The predetermined time range may be set, for example, to approximately 12:00 am to approximately 10:00 am, daily, or another suitable daily time range when the heat pump system (and more specifically air conditioning) is expected to remain off.

Figure 13:
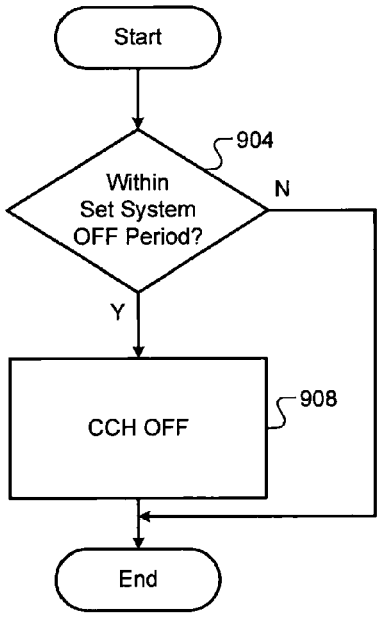

FIG. 13 is a flowchart depicting another example method of controlling the CCH. Referring now to FIG. 13, control may begin with 904 where the compressor 10 is off. At 904, the power control module 104 determines whether the current date and time is within a predetermined system OFF period. The predetermined system OFF period may refer to a period from entry of the predetermined system OFF period when the heat pump system will remain off. The predetermined system OFF period may be provided by a user via the thermostat or via a network connection (e.g., by a server or a mobile device).

The power control module 104 may record the current date and time when the predetermined system OFF period is provided. If the current date and time is within the predetermined system OFF period following the recorded date and time, the power control module 104 may turn the CCH off at 908. If the current date and time is outside of the predetermined system OFF period following the recorded date and time, the power control module 104 may leave the on/off state of the CCH unchanged.

Figure 14:
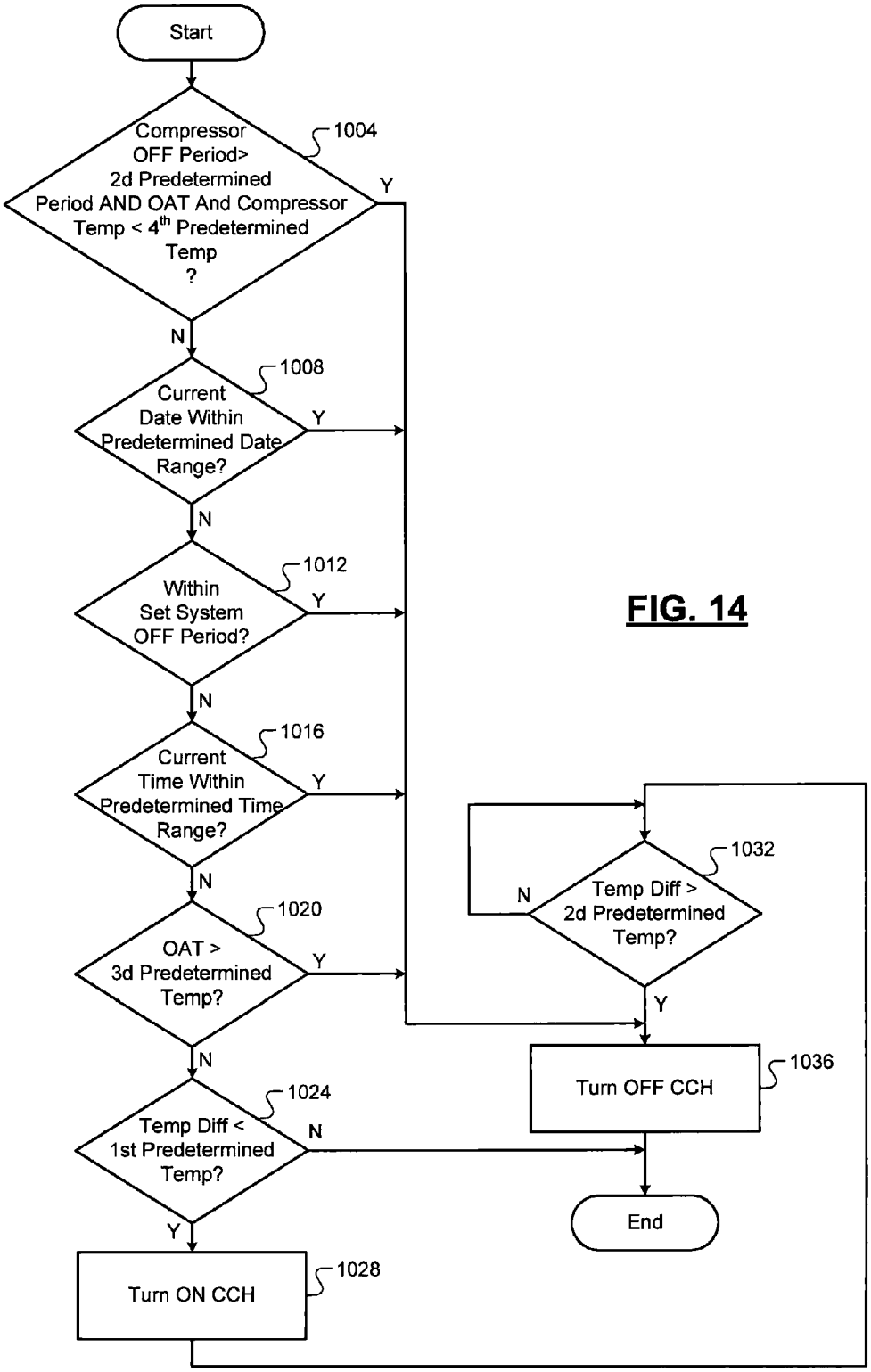

FIG. 14 is a flowchart depicting another example method of controlling the CCH. Referring now to FIG. 14, control may begin with 1004 where the compressor 10 is off. The CCH may also be off at 1004. At 1004, the power control module 104 determines whether the compressor off period is greater than the second predetermined period and the OAT and the compressor temperature are less than the fourth predetermined temperature. If true, the power control module 104 may turn the CCH off at 1036. If false, control may continue with 1008.

At 1008, the power control module 104 determines whether the current date indicated by the current date and time data is within the predetermined date range. If true, the power control module 104 may turn the CCH off at 1036. If false, control may continue with 1012. The power control module 104 determines whether the current date and time is within the predetermined system OFF period at 1012. If true, the power control module 104 may turn the CCH off at 1036. If false, control may continue with 1016.

The power control module 104 determines whether the whether the current time indicated by the current date and time data is within the predetermined time range at 1016. If true, the power control module 104 may turn the CCH off at 1036. If false, control may continue with 1020. At 1020, the power control module 104 determines whether the OAT is greater than the third predetermined temperature. If true, the power control module 104 may turn the CCH off at 1036. If false, control may continue with 1024.

At 1024, the power control module 104 determines whether the temperature difference (e.g., OAT minus compressor temperature) is less than the first predetermined temperature. If true, the power control module 104 may turn the CCH on at 1028, and control may continue with 1032. If false, control may end.

At 1032, the power control module 104 determines whether the temperature difference is greater than the second predetermined temperature. If true, the power control module 104 may turn the CCH off at 1036. If false, the power control module 104 may leave the CCH on and remain at 1032. While the above order has been provided for 1004-1036, the order of execution of one or more of 1004-1036 may be changed.

Figure 15A:
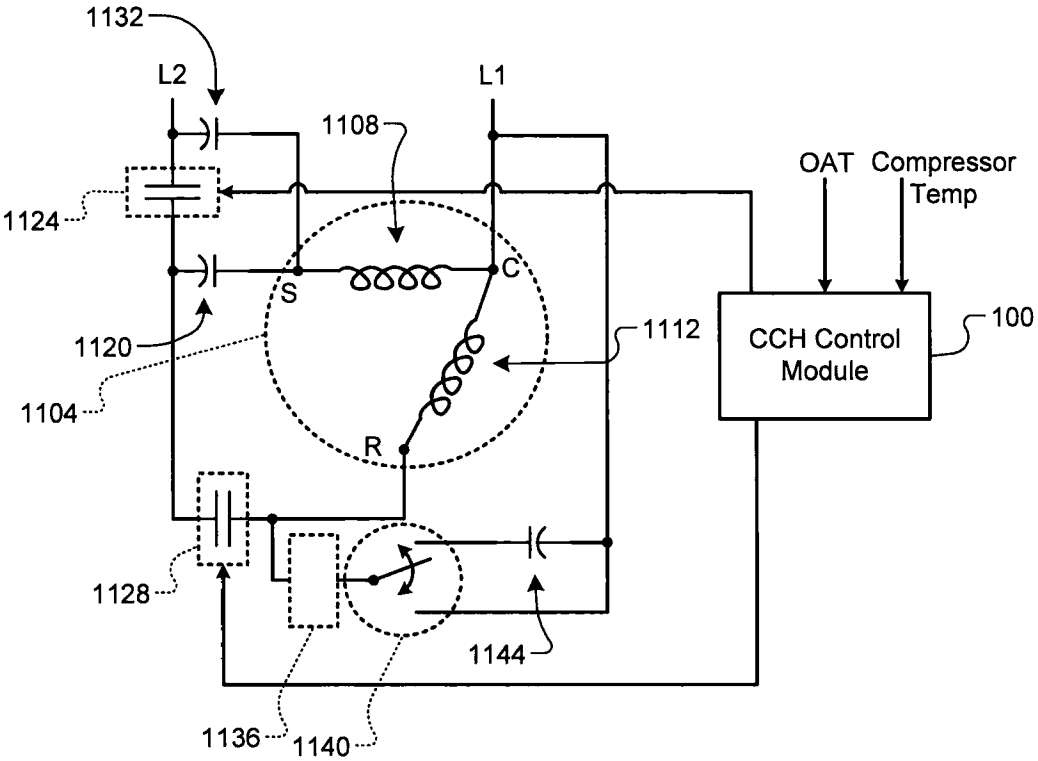
FIGS. 15A-15B are functional block diagrams of example crankcase heating control systems of example single phase heat pump systems according to the present disclosure.
Figure 15B:
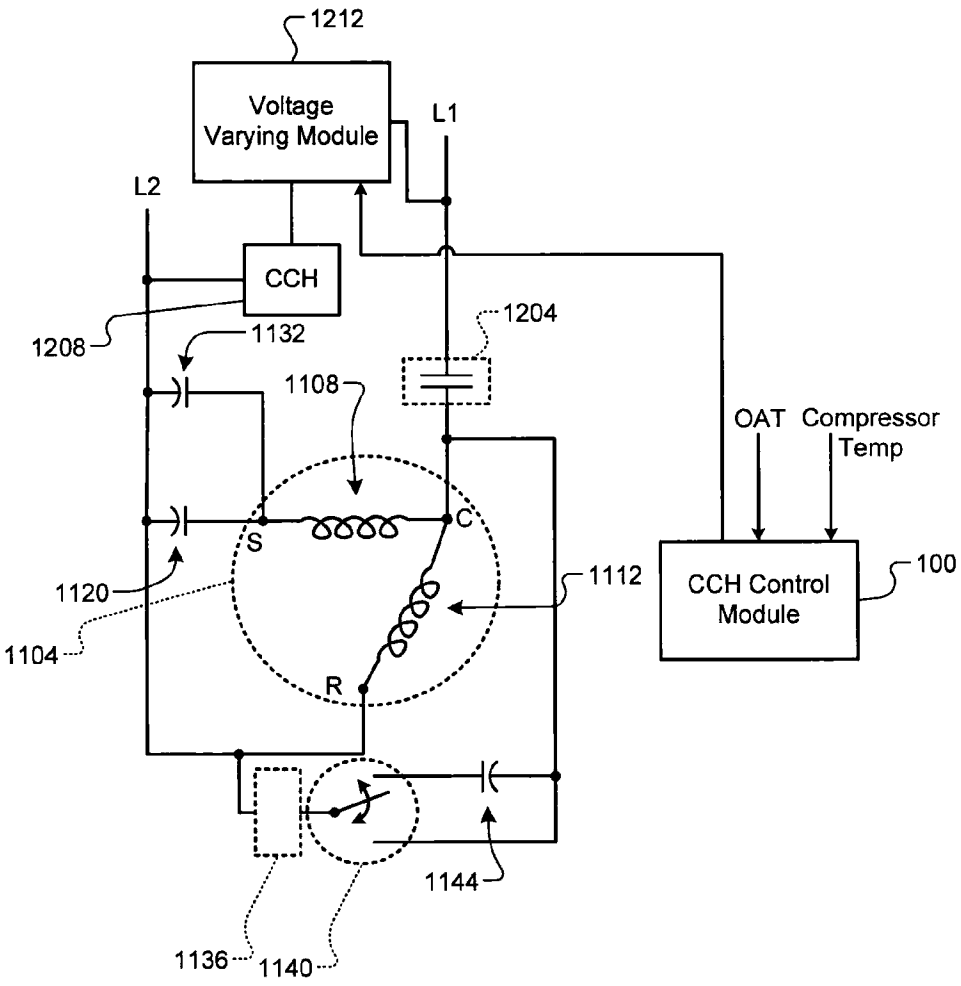

FIGS. 15A and 15B are functional block diagrams of example CCH systems of example single phase heat pump systems. Referring now to FIG. 15A, a first power line (L1) is connected to a common node (C) of an electric motor 1104 of the compressor 10. A start winding 1108 is connected between the common node and a second node (S). A run winding 1112 is connected between the common node and a third node (R).

The second node (S) is connected to a second power line (L2) via a run capacitor 1120 and a normally open (NO) switching device (e.g., contactor) 1124. A normally closed (NC) switching device (e.g., relay) 1128 is connected between the third node (R) and the NO switching device 1124. Optionally, a second run capacitor 1132 may be connected between the second node (S) and the second power line. While the NC switching device 1128 is shown as external to the CCH control module 100, the NC switching device 1128 may be integrated within the CCH control module 100.

The CCH control module 100 controls the NO and NC switching devices 1124 and 1128 to control the CCH. In this implementation, the stator of the electric motor 1104 acts as the CCH. More specifically, the run capacitor 1120 and the start winding 1108 act as the CCH. Use of the stator as the CCH may be referred to as a trickle circuit.

An electric motor 1136 of the condenser fan 13 may also be connected between the first power line and NC switching device 1128. A third switching device 1140 may be switched to control whether power is input to the electric motor 1136 via a third run capacitor 1144 or via the first power line. The control module 25 may control the third switching device 1140.

The power control module 104 opens both the NO and NC switching devices 1124 and 1128 to turn the CCH off, the compressor 10 off, and the condenser fan 13 off. The power control module 104 opens the NC switching device 1128 and closes the NO switching device 1124 to turn the CCH on, the compressor 10 off, and the condenser fan 13 off. In this configuration, the CCH is on and the compressor 10 is off. This may be referred to as a CCH on state. The power control module 104 closes both the NO and NC switching devices 1124 and 1128 to turn the condenser fan 13 on, the compressor 10 on, and the CCH off. In this configuration, the CCH is off and the compressor 10 is on. This may be referred to as a normal state.

The power control module 104 may control the application of power to the stator to achieve a target wattage. For example, the power control module 104 may control the duty cycle of the stator based on the target wattage. Duty cycle of the stator may refer to the period that power is applied to the stator (i.e., CCH is on) during a predetermined period. The amount of heat provided by the stator may depend on the period that power is applied to the stator and the wattage of the stator. The wattage of the stator may depend on characteristics of the capacitor(s) and other characteristics. The duty cycle may be set to a predetermined value, for example, based on experimental data taken regarding rate of liquid migration to the compressor shell. The type of expansion device used (e.g., fixed orifice, thermal, etc.) and other factors may affect the rate of liquid migration to the compressor shell.

Referring now to FIG. 15B, a normally open (NO) switching device 1204 may be connected between the first power line (L1) and the common node of the electric motor 1104 of the compressor 10. The CCH control module 100 may control the NO switching device 1204 to control operation of the electric motor 1104 of the compressor 10 and the electric motor 1136 of the condenser fan 13.

A compressor crankcase heater (CCH) 1208 is connected between the first and second power lines via a voltage varying module 1212. The CCH 1208 may include a resistive heating element, such as a belly-band electric heater or a PTC electric heater. The voltage varying module 1212 controls application of power to the CCH 1208. The voltage varying module 1212 may actively or passively control application of power to the CCH 1208 and may include, for example, a variac. For example, in the case of an active voltage varying module 1212, the voltage varying module 1212 may control application of power to the CCH 1208 based on input from the power control module 104. The voltage varying module 1212 disables current flow through the CCH 1208 to disable crankcase heating.

Figure 16:
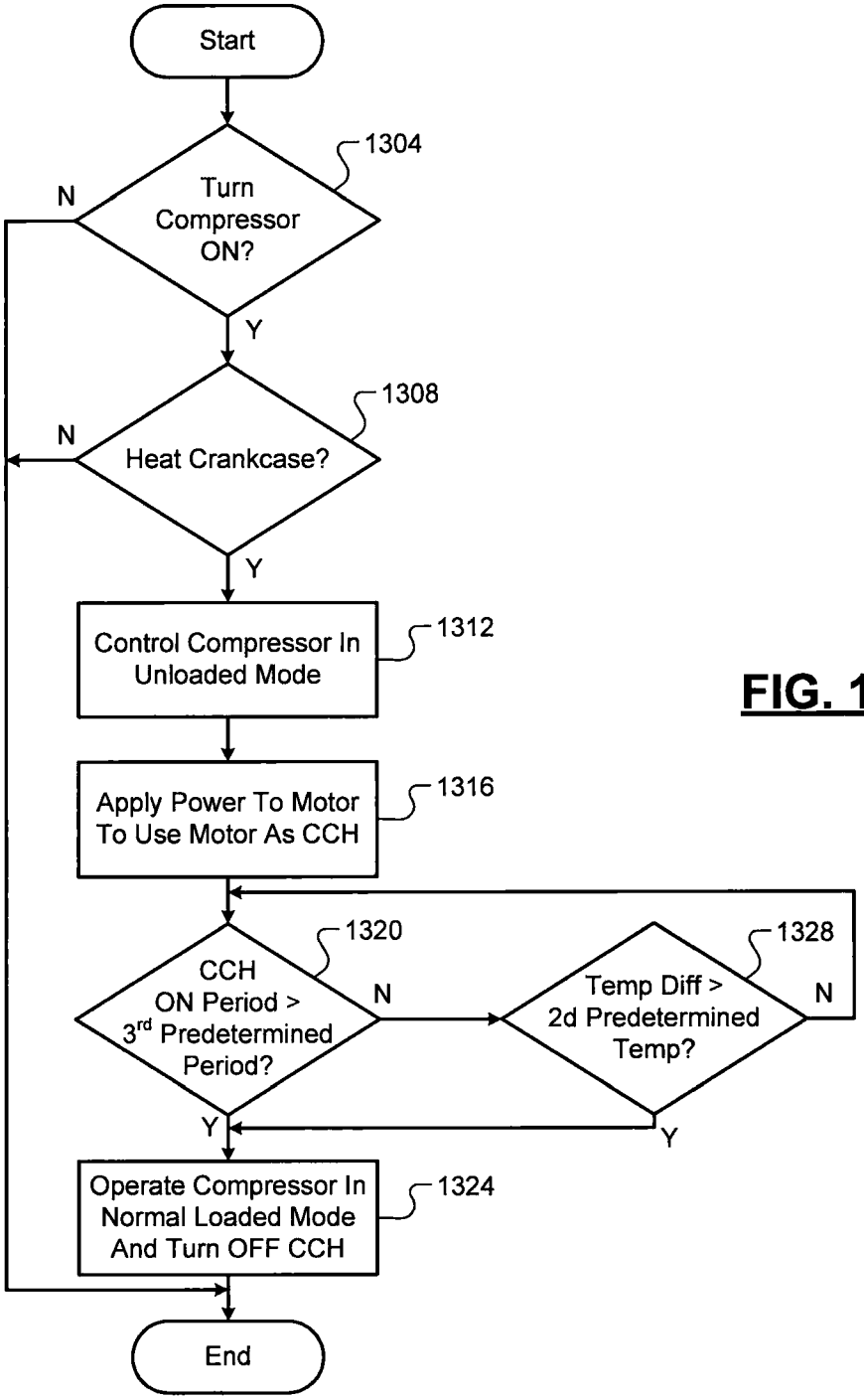
FIG. 16 is a flowchart depicting an example method of controlling heating of a crankcase of a scroll compressor at compressor startup according to the present disclosure.

FIG. 16 is a flowchart depicting an example method of controlling heating of a crankcase of a scroll compressor at compressor startup. Referring now to FIG. 16, control may begin with 1304 where the control module 25 determines whether to turn on the scroll compressor. If true, control continues with 1308. If false, control may end.

At 1308, the power control module 104 determines whether crankcase heating should be performed, for example, as described above. If true, control continues with 1312. If false, control may end, and the compressor 10 may start normally. At 1312, the control module 25 transitions the scroll compressor to the unloaded mode where the scrolls of the scroll compressor are separated and the scroll compressor does not compress refrigerant. The power control module 104 applies power to the motor of the scroll compressor at 1316. Application of power to the motor in the unloaded mode uses the motor as the CCH. Other methods of compressor unloading may be utilized, such as blocking suction gas from entering the compression chambers. For another example, rotary vane type compressors can separate their vanes from their rollers to avoid compression and to operate in an unloaded mode.

At 1320, the power control module 104 determines whether the period that crankcase heating has been performed ("CCH on period") is greater than a third predetermined period. If so, the control module 25 transitions the scroll compressors to the normal mode where the scrolls are meshed and the scroll compressor compresses refrigerant at 1324. If false, control may transition to 1328. The third predetermined period may be set, for example, to approximately 10 minutes or another suitable period. The third predetermined period may be set, for example, based on the wattage of the motor and a target power consumption.

At 1328, the power control module 104 determines whether the temperature difference is greater than the second predetermined temperature. If true, control may transition to 1324, as discussed above. If false, control may return to 1320.

Figure 17:
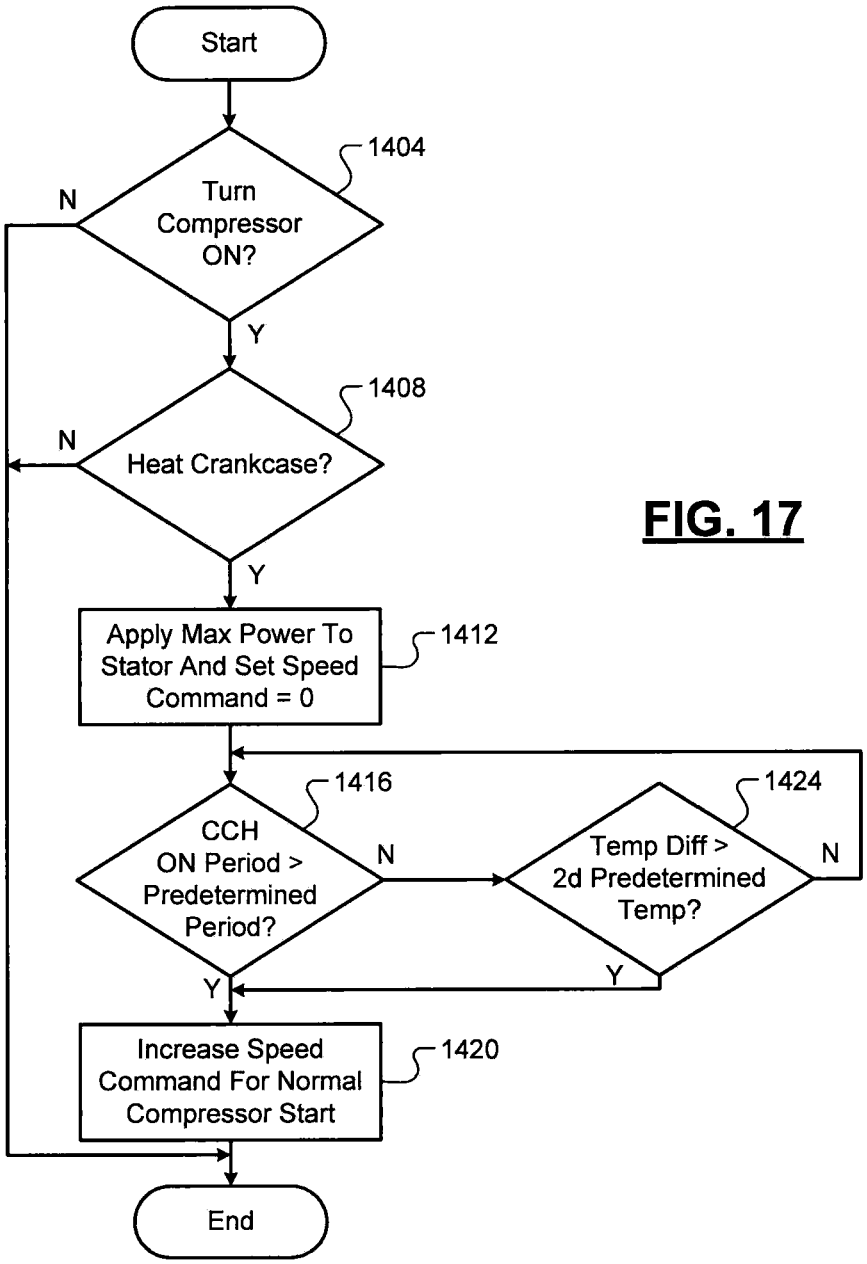
FIG. 17 is a flowchart depicting an example method of controlling heating of a crankcase of a variable speed compressor at compressor startup according to the present disclosure.

FIG. 17 is a flowchart depicting an example method of controlling heating of a crankcase of a variable speed compressor at compressor startup. Referring now to FIG. 17, control may begin with 1404 where the control module 25 determines whether to turn on the variable speed compressor. If true, control continues with 1408. If false, control may end.

At 1408, the power control module 104 determines whether crankcase heating should be performed, for example, as described above. If true, control continues with 1412. If false, control may end, and the compressor 10 may start normally. At 1412, the control module 25 applies power (e.g., a predetermined maximum voltage) to the stator of the motor of the scroll compressor and sets a speed command for the motor equal to zero. The speed command being set equal to zero ensures that the application of power to the stator does not drive the rotor of the motor. The application of power to the motor in the unloaded mode uses the motor as the CCH.

At 1416, the power control module 104 determines whether the period that crankcase heating has been performed ("CCH on period") is greater than a third predetermined period. If so, the control module 25 selectively increases (e.g., ramps up) the speed command at 1420. The rotor is therefore driven as to achieve the speed command. If false, control may transition to 1424. At 1424, the power control module 104 determines whether the temperature difference is greater than the second predetermined temperature. If true, control may transition to 1420, as discussed above. If false, control may return to 1416. While the example methods are shown as ending, each of the methods shown and described may be illustrative of one control loop and one control loop may be initiated every predetermined period.

A crankcase heating control system for a heat pump system comprises: a data receiving module that receives data indicative of a temperature of a compressor of the heat pump system, data indicative of an ambient temperature, and data indicative of a current date and a current time; and a power control module that selectively applies power to a heater of a crankcase of the compressor and that selectively disables the heater based on the temperature of the compressor, the ambient temperature, the current date, and the current time.

In further features, the power control module disables the heater of the crankcase when the current date is within a predetermined date range.

In still further features, the power control module disables the heater of the crankcase when the current time is within a predetermined daily time range.

In yet further features, the power control module disables the heater of the crankcase when all of: a period since the compressor stopped pumping is greater than a predetermined period; the ambient temperature is less than a predetermined temperature; and the temperature of the compressor is less than the predetermined temperature.

In further features, the power control module receives a predetermined period input by a user and disables the heater of the crankcase when the current date and time is within the predetermined period.

In still further features, the power control module disables the heater of the crankcase for at least three hours following a time when the compressor stopped pumping.

In further features, the crankcase heating control system further comprises a difference module that sets a temperature difference equal to the temperature of the compressor minus the ambient temperature. The power control module disables the heater of the crankcase when the temperature difference is greater than a predetermined temperature.

In yet further features, the power control module applies power to the heater of the crankcase when the temperature difference is less than a second predetermined temperature that is less than the predetermined temperature.

In further features, the power control module disables the heater of the crankcase when the ambient temperature is greater than a predetermined temperature.

In still further features, the temperature of the compressor is one of a discharge line temperature of the compressor, a temperature of a motor of the compressor, a temperature of lubricant within the compressor, an upper shell temperature, and a lower shell temperature.

In yet further features, the power control module selectively applies power to the heater while the compressor is off and selectively disables the heater while the compressor is off.

In further features, a crankcase heating system comprises: the crankcase heating control system, and the heater of the crankcase. The heater includes one of an electric heater that encircles a shell of the compressor, a positive temperature coefficient (PTC) electric heater disposed within the shell of the compressor, and a motor of the compressor.

In yet further features, a heat pump system comprises: a compressor; first and second heat exchangers; an expansion valve; and a control module that includes a processor and memory, the memory including instructions that, when executed, perform the functions of: while the compressor is off, selectively applying power to a heater of a crankcase of the compressor; and while the compressor is off, selectively disabling the heater based on a temperature of the compressor, an ambient temperature, a current date, and a current time.

In still further features, a crankcase heating control method for a heat pump comprises: receiving data indicative of a temperature of a compressor of the heat pump system; receiving data indicative of an ambient temperature; receiving data indicative of a current date and a current time; selectively applying power to a heater of a crankcase of the compressor; and selectively disabling the heater based on the temperature of the compressor, the ambient temperature, the current date, and the current time.

In yet further features, the selectively disabling the heater comprises disabling the heater of the crankcase when the current date is within a predetermined date range.

In still further features, the selectively disabling the heater comprises disabling the heater of the crankcase when the current time is within a predetermined daily time range.

In yet further features, the selectively disabling the heater comprises disabling the heater of the crankcase when all of: a period since the compressor stopped pumping is greater than a predetermined period; the ambient temperature is less than a predetermined temperature; and the temperature of the compressor is less than the predetermined temperature.

In further features, the selectively disabling the heater comprises: receiving a predetermined period input by a user; and disabling the heater of the crankcase when the current date and time is within the predetermined period.

In still further features, the selectively disabling the heater comprises disabling the heater of the crankcase for at least three hours following a time when the compressor stopped pumping.

In yet further features, the method further comprises: setting a temperature difference equal to the temperature of the compressor minus the ambient temperature; and disabling the heater of the crankcase when the temperature difference is greater than a predetermined temperature.

In still further features, the method further comprises applying power to the heater of the crankcase when the temperature difference is less than a second predetermined temperature that is less than the predetermined temperature.

In further features, the selectively disabling the heater comprises disabling the heater of the crankcase when the ambient temperature is greater than a predetermined temperature.

In still further features, the temperature of the compressor is one of a discharge line temperature of the compressor, a temperature of a motor of the compressor, a temperature of lubricant within the compressor, an upper shell temperature, and a lower shell temperature.

In yet further features, the selectively disabling the heater comprises selectively disabling the heater while the compressor is off, and the selectively applying power to the heater comprises selectively applying power to the heater while the compressor is off.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A crankcase heating control system for a heat pump system, the crankcase heating control system comprising:

a data receiving module that receives data indicative of a temperature of a compressor of the heat pump system, data indicative of an ambient temperature, and data indicative of a current date and a current time;

a power control module that selectively applies power to a heater of a crankcase of the compressor and that selectively disables the heater based on the temperature of the compressor, the ambient temperature, the current date, and the current time; and a difference module that sets a temperature difference equal to the temperature of the compressor minus the ambient temperature, wherein the power control module disables the heater of the crankcase when the temperature difference is greater than a predetermined temperature.

2. The crankcase heating control system of claim 1 wherein the power control module applies power to the heater of the crankcase when the temperature difference is less than a second predetermined temperature that is less than the predetermined temperature.

3. A crankcase heating control method for a heat pump system, the crankcase heating control method comprising:

receiving data indicative of a temperature of a compressor of the heat pump system;

receiving data indicative of an ambient temperature;

receiving data indicative of a current date and a current time;

selectively applying power to a heater of a crankcase of the compressor;

selectively disabling the heater based on the temperature of the compressor, the ambient temperature, the current date, and the current time;

setting a temperature difference equal to the temperature of the compressor minus the ambient temperature; and disabling the heater of the crankcase when the temperature difference is greater than a predetermined temperature.

4. The crankcase heating control method of claim 3 further comprising applying power to the heater of the crankcase when the temperature difference is less than a second predetermined temperature that is less than the predetermined temperature.

* * * * *